US006085053A

United States Patent [19]

Saeki

[11] Patent Number: 6,085,053

[45] Date of Patent: Jul. 4, 2000

[54] RECORDING DEVICE

[75] Inventor: Tomoya Saeki, Niigata, Japan

[73] Assignee: NEC Corporation, Tokyo, Japan

[21] Appl. No.: 09/199,278

[22] Filed: Nov. 25, 1998

[30] Foreign Application Priority Data

Nov. 26, 1997 [JP] Japan ..... 9-324011

[51] Int. Cl.[7] ..... G03G 15/00

[52] U.S. Cl. ..... 399/165

[58] Field of Search ..... 399/165, 162; 474/126, 109, 136, 137, 133, 110, 112; 198/813, 816

[56] References Cited

U.S. PATENT DOCUMENTS

| | | | |
|---|---|---|---|
| 5,518,457 | 5/1996 | Seki et al. | 474/102 |
| 5,659,851 | 8/1997 | Moe et al. | 399/165 |

FOREIGN PATENT DOCUMENTS

| | | |
|---|---|---|
| 58-110609 | 7/1983 | Japan . |
| 61-272622 | 12/1986 | Japan . |
| 62-269974 | 11/1987 | Japan . |
| 2-198936 | 8/1990 | Japan . |
| 3-214452 | 9/1991 | Japan . |
| 4-133928 | 5/1992 | Japan . |
| 4-168644 | 6/1992 | Japan . |
| 4328762 | 11/1992 | Japan . |
| 6-011001 | 1/1994 | Japan . |
| 7-048014 | 2/1995 | Japan . |
| 8286562 | 11/1996 | Japan . |
| 9062048 | 3/1997 | Japan . |

*Primary Examiner*—Matthew S. Smith
*Assistant Examiner*—Greg Moldafsky
*Attorney, Agent, or Firm*—Foley & Lardner

[57] ABSTRACT

A recording device enables the tension state of an endless belt type photographic body to be adjusted so as to maintain a proper tension, including adjusting for, changes of belt length caused by the change of temperature and humidity or the change with time of employment surroundings, and also adjusting for the change of belt tension entailed by load variation on operation of the device or eccentricity of the driving roller. The recording device is provided with a driving roller, driven rollers, and the endless belt type photographic body which is wound around the driving roller, and the driven rollers, the driving roller driving the driven rollers. The recording device is also provided with a sensor for detecting the tension of the endless belt type photographic body, and a movement mechanism for moving at least one of the driving roller and the driven rollers based on a detection signal of the sensor.

15 Claims, 2 Drawing Sheets

RECORDING DEVICE

BACKGROUND OF THE INVENTION

The present invention relates to a recording device utilizing an electrophotographic method. Particularly, this invention relates to a recording device having a belt tension regulating mechanism for regulating the tension state of an endless belt type photographic body.

DESCRIPTION OF THE RELATED ART

In the conventional recording device utilizing the electrophotographic method, a discharge unit is used, prior to printing out, in order to cause electric charges, which remain on the photographic body through the previous processing, to be removed. Next, a charge is given uniformly to the surface of the photographic body by a charging unit such as a Corona, Charging Roller or other devices, before the LED light or laser light from an exposing unit aims at the surface of the photographic body, so that a latent image is formed while changing the surface of the photographic body into a charge distribution state corresponding to the image. Further, a Developing unit causes the toner image to be formed while absorbing charged toner to the surface of the photographic body in answer to the charge distribution. The Transferring unit transfers the toner image to a recording medium such as a sheet or film, either directly or through an intermediate medium.

In the conventional recording device described above, there is a form using a photographic body supported by an endless belt type supporting body (hereinafter referred to as an endless belt type photographic body). In this recording device, the endless belt type photographic body is wound around a plurality of supporting rollers, thus maintaining accurately the relative position of the endless belt type photographic body and respective processing units of Discharge, Charge, Exposure, Development, and Transfer. The supporting roller consists of driven rollers which revolve in accordance with the circulation of the endless belt type photographic body, and a driving roller for giving revolving force to the endless belt type photographic body. Appropriate tension is always given to the endless belt type photographic body in order to implement accurate circulation according to the driving roller and to maintain the exact relative position of the endless belt type photographic body and the respective processing units.

The Japanese Patent Application Laid-Open No. SHO 62-269974 discloses a recording device having a tension adjustment mechanism of the endless belt type photographic body. The recording device described above always gives tension to the endless belt type photographic body wound around the respective supporting rollers by always energizing two rollers that are side by side and within a plurality of supporting rollers held apart from each other by a spring.

Further, in order to give appropriate tension to the endless belt type photographic body, it is known to provide the recording device with a fixed adjusting structure for fixing the position, while moving at least one of a plurality of supporting rollers for supporting the endless belt type photographic body in the direction of changing tension of the endless belt type photographic body.

In the recording device described in the above official gazette published application, the tension which is given to the endless belt type photographic body changes from an initial appropriate value. Even though tension of the endless belt type photographic body is adjusted appropriately at a device manufacturing step, it is incapable of being lowering of energizing force of the spring for isolating the supporting rollers, for a change of temperature and humidity in the employment surroundings or for a change with time of the length of the endless belt type photographic body. In this case, the output quality at the image formation step deteriorates because the tension state of the endless belt type photographic body becomes inappropriate, thus causing errors such as an oscillation of the belt, or a variation of the feeding speed.

Furthermore, in the conventional recording device with a fixed adjusting structure, when exchanging the endless belt type photographic body which is fatigued by heat, light, charging or discharging, the work is complicated because the tension of the endless belt type photographic body should always be adjusted in every in every after exchanging the belt. Moreover, the adjusting work of the belt tension is implemented in answer to the change of temperature and humidity or the change with time, or for every belt exchange, it cannot cope with a load variation on the operation of the device or the change of the belt tension accompanied with the eccentricity of the supporting roller and so forth.

SUMMARY OF THE INVENTION

In view of the foregoing, it is an object of the present invention to provide a recording device which is capable of being adjusted appropriately to maintain a tension state of an endless belt type photographic body such that the tension state can follow the change of temperature and humidity in the employment surroundings and the change with time of belt length, or the change of belt tension accompanying with a load variation on the operation of the device or the eccentricity of the rollers and so forth.

According to one aspect of the present invention, for achieving the above-mentioned object, there is provided a recording device including a driving roller, driven rollers, and an endless belt type photographic body wound around said driving roller and said driven rollers being driven by the driving roller to drive the driven rollers. The recording device comprises a belt tension detection device for detecting tension of the endless belt type photographic body, and a movement device for moving at least one of the driving roller and the driven rollers based on a detection signal of the belt tension detection device.

According to another aspect of the present invention, there is provided a recording device in which the movement device comprises an eccentric cam whose relative position toward the driving roller is fixed, and a rod which causes the driven rollers either to approach or to depart in terms of the driving roller in accordance with the revolution of the eccentric cam.

According to still another aspect of the present invention there is provided a recording device in which the belt tension detection device comprises a sensor which detects deformation under pressure of the rod to convert it into an electric signal, and thus the revolution and resulting angle of the eccentric cam is adjusted based on the electric signal from the sensor.

According to still another aspect of the present invention there is provided a recording device in which the movement device comprises a female screw section whose relative position toward the driving roller is fixed, and a lead screw which causes the driven rollers either to approach or to depart in terms of the driving roller, while moving back and forth along an axial line when the lead screw is screwed in the female screw section so as to revolve the female screw section.

According to still another aspect of the present invention there is provided a recording device in which the belt tension detection device comprises a sensor for detecting deformation under pressure of the lead screw to convert it into an electric signal, and thus the revolution quantity of the lead screw is adjusted based on the electric signal from the sensor.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

Figure 1:
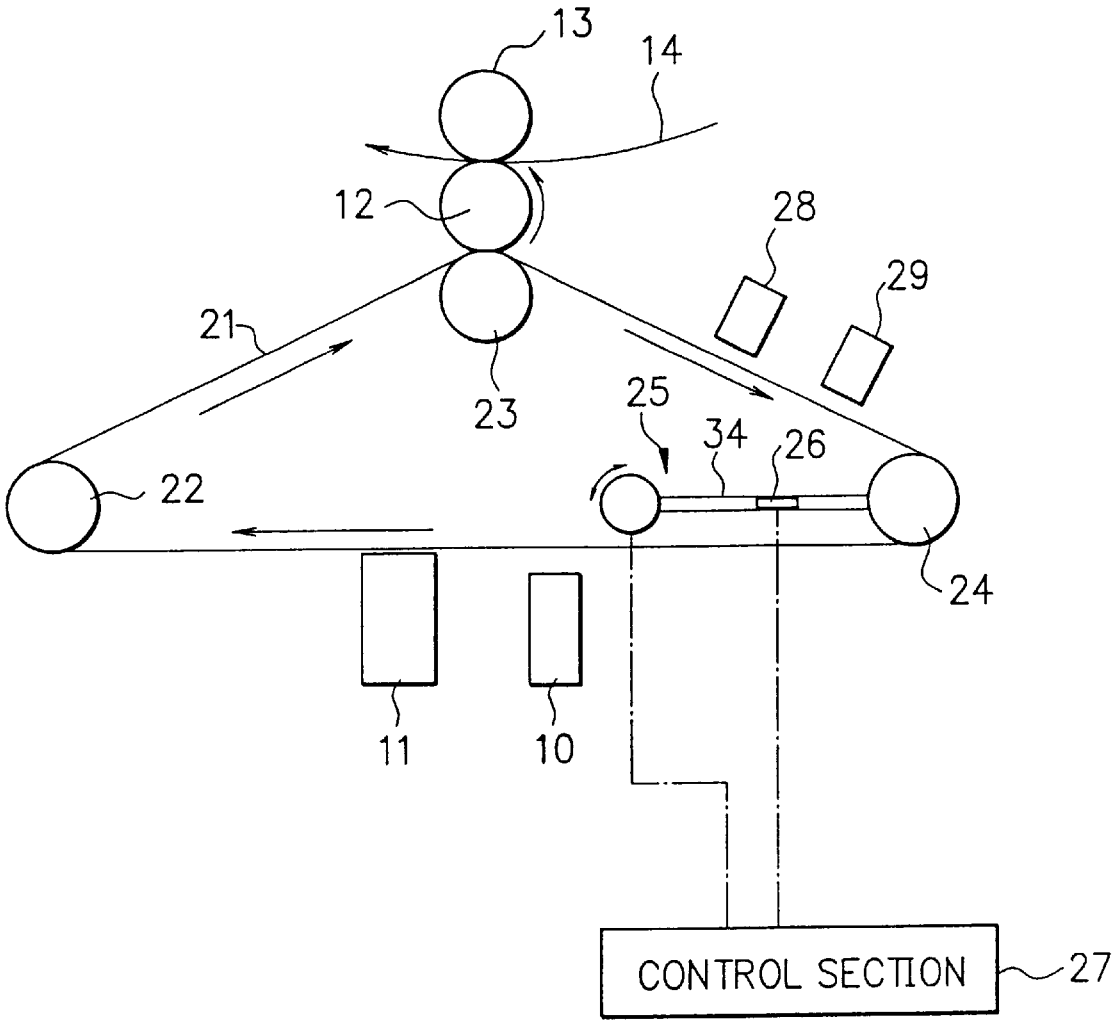
FIG. 1 is a front elevation showing a belt tension regulating mechanism typically of a recording device according to a first embodiment of the present invention.

A preferred embodiment of the invention will be described in detail with reference to the accompanying drawings. FIG. 1 is a front elevation showing a belt tension regulating mechanism typically of a recording device according to a first embodiment of the present invention. The recording device is provided with driving roller 22 and driven rollers 23, 24 which are located at the respective three vertexes of a triangle to be supported by a device body. The endless belt type photographic body 21 is wound around the driving roller 22 and the driven rollers 23, 24. The recording device is driven by the driving roller 22. The driven rollers 23, 24 are revolved in accordance with the endless-belt type photographic body 21 which circulates.

A developing unit 11 and an exposing unit 10 are arranged at an opposite location to lower surface of the endless belt type photographic body 21. A discharging unit 28 and a charging unit 29 are arranged at an opposite location to one side surface of an inclined section of the endless belt type photographic body 21. A transfer roller 12 which comes into contact with the endless belt type photographic body 21 is arranged at an opposite location to the driven rollers 23 through the endless belt type photographic body 21. A fixing roller 13 which is in contact with the transfer roller 12 with a prescribed pressure is arranged above the transfer roller 12.

Figure 2:
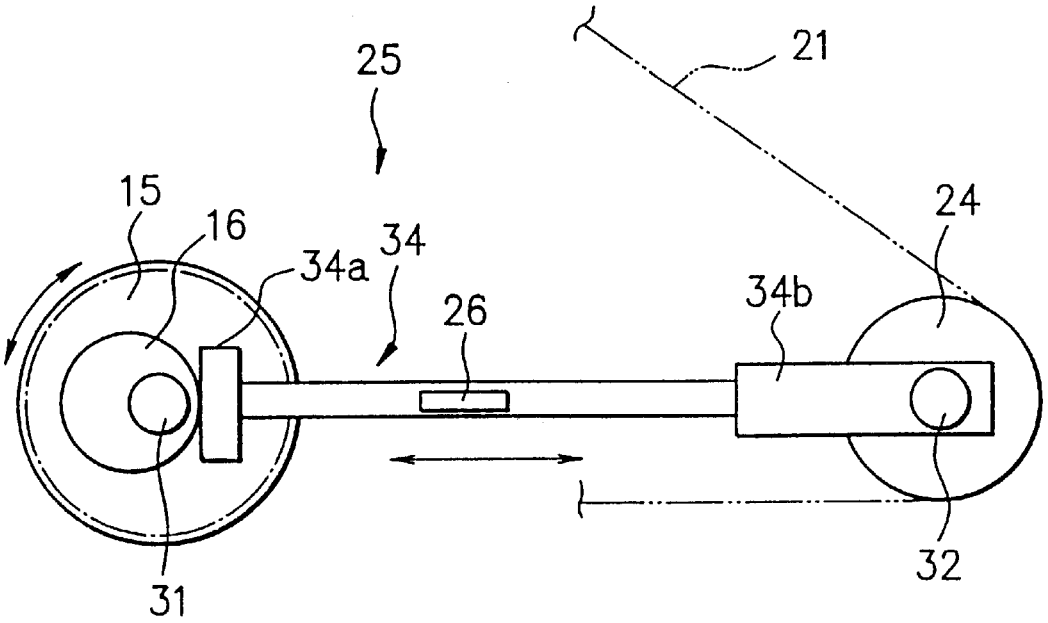
FIG. 2 is a side view showing a movement mechanism and a neighborhood thereof with these portions enlarged according to the first embodiment.

The recording device is provided with a movement mechanism 25 and a control section 27. FIG. 2 is a side view showing a movement mechanism 25 and a neighborhood thereof with these portions enlarged. The movement mechanism 25 is provided with an eccentric cam 16 and a rod 34. The relative position of the driving roller 22 of FIG. 1 and the eccentric cam 16 of FIG. 2 is fixed. The rod 34 causes the driven rollers 24 to approach the driving roller 22 or to depart from the driving roller 22 in accordance with revolution of the eccentric cam 16. The eccentric cam 16 is fastened to a gear 15 revolving on the central axis 31 as its center. The gear 15 revolves in the regular direction or opposite direction in answer to the revolution of the driving motor, that is not illustrated.

The rod 34 is provided with a pressed section 34*a* at one end thereof and a support section 34*b* for supporting the driven rollers 24 rotatably. The rod 34 is supported slidably in the right and left direction of FIG. 2 and is supported in a condition so that up and down movement of FIG. 2 is restricted by a supporting means (not illustrated). Pressing force received through the driven rollers 24 from the endless belt type photographic body 21 causes the pressed section 34*a* to come into contact with the eccentric cam 16.

A sensor (belt tension detection means) 26 is fixed to approximately the center portion of the rod 34. The sensor 26 detects deformation under pressure of the rod 34 so as to convert it to an electric signal in order to detect tension of the endless belt type photographic body 21. The sensor 26 can comprise the strain gauge which catches the deformation under pressure of the rod 34 by way of a change of electric resistance that is converted to an electric signal. In this case, it is capable of being answered to a necessary detection precision, response speed, cost and so forth. The sensor 26 also can comprise a Hall element which detects the deformation under pressure of the rod 34 indirectly with a non-contact technique to convert to and generate the electric signal, or by a transparent optical sensor or a reflective optical sensor or the like.

The control section 27 consists of a micro computer and so forth. The control section 27 controls the roller movement quantity and the movement direction according to the movement mechanism so as to become equal with the reference value of tension established previously, while regulating rotational the angle of the eccentric cam 16 by controlling the driving motor based on the electric signal from the sensor 26.

The recording device described above will be operated in accordance with following manner: In the record operation state, the necessary tension for a feed driving is given to the endless belt type photographic body 21 by the driving roller 22 and the driven rollers 23, 24. When the driving roller 22 starts its revolution, the endless belt type photographic body 21 circulates, while being supported by the driving roller 22, and the driven rollers 23, 24.

In the case of circulation, all charges remaining on the endless belt type photographic body 21 are removed by exposure of the discharging unit 28. The charges are given homogeneously to the endless belt type photographic body 21 by the charging unit 29, before laser light (or LED light) is irradiated by the exposing unit 10, and thus a latent image is formed in such a way that the surface is changed into a charge distribution corresponding to the image to be formed. In the developing unit, the endless belt type photographic body 21 attracts the charged toner corresponding to the charge distribution of the photographic body surface, thus the toner image is formed. The toner image that is formed on the endless belt type photographic body 21 is then transferred on the transferring roller 12 which is an intermediate medium, before being transferred on the recording medium such as a sheet, film and so forth which are passed through contact section between the transferring roller 12 and the fixing roller 13, simultaneously, being subjected to a heat fixing by heat and pressure that is supplied from the fixing roller 13.

In the recording device, of the above operation, the deformation under pressure of the rod 34 according to the tension of the endless belt type photographic body 21 is detected by the sensor 26. Thus the detection signal thereof is inputted regularly to the control section 27. When the control section 27 determines that the belt tension deviates from an appropriate value based on the detection signal from the sensor 26, the control section 27 causes the driving motor to revolve in the regular direction or in the reverse direction so far as to equalize the tension of the endless belt type photographic body 21 and to the reference value, while outputting the control signal to the movement mechanism 25.

When the driving motor revolves, the eccentric cam 16 causes a pressing quantity to the pressed section 34*a* of the rod 34 to vary corresponding to the rotational angle. For this reason, the driven rollers 24 move in the direction of being opposed to the tension of the endless belt type photographic body 21 or in the following direction of tension so that it causes the relative position of the driven rollers 24 and the driving roller 22 to vary to cause the tension of the endless belt type photographic body 21 to be an appropriate value. Consequently, the change of belt length caused by the change of temperature and humidity or the change with time of employment surroundings can be handled. The change of belt tension entailed by a load variation on the operation of the device or eccentricity of the driving roller 22, the driven rollers 23, 24 can be handled. It is capable of being always maintained with an appropriate tension state, while absorbing the looseness of the endless belt type photographic body.

For instance, in the experimentation a using resinous belt of peripheral length of about 400 mm by way of the supporting body of the endless belt type photographic body 21, the main frequency component at feed speed variation converges on less than 20 Hz. In this case, it is not necessary to provide high speed detection or correction performance with the control section 27, because only the frequency component is capable of being corrected.

Figure 3:
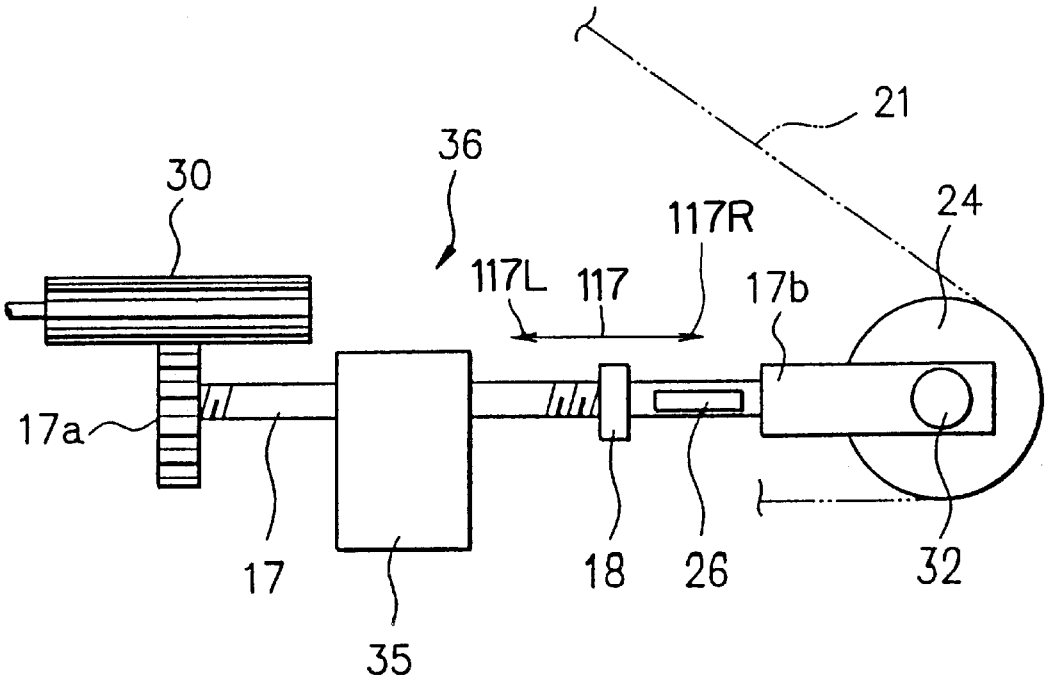
FIG. 3 is a side view showing a movement mechanism and a neighborhood thereof with these portions enlarged according to a second embodiment.

FIG. 3 is a side view showing an enlarged movement mechanism and the neighborhood thereof of the recording device according to the second embodiment of the present invention. The movement mechanism 36 is provided with a female screw section 35 whose relative position to the driving roller 22 is fixed, and a lead screw 17. The lead screw 17 is screwed so as to be fitted in the female screw section 35. A driven gear 17*a* is fixed to one end and driven rollers 24 are rotatably supported through an axis 32 by the supporting section 17*b* formed on another end. The lead screw 17 is supported movably in the direction of right and left along axis line 117 of FIG. 3 by a supporting member 18 fixed to the device body and supporting member which is not illustrated.

A driven gear 17*a* is engaged with a driving gear 30 which is relatively dimensionally long in the axial direction 117 and which receives a rotational force from a driving source that is not illustrated. When the driven gear 17*a* revolves while receiving the revolution of the driving gear 30, the driven gear 17*a* causes the lead screw 17 to revolve in terms of the female screw section 35. For this reason, the lead screw 17 causes the driven rollers 24 to approach or to depart from the driving roller 22, while moving left or right along the axial 117. The above-described sensor 26 which detects the deformation under the pressure of the lead screw 17 so as to convert it to the electric signal is fixed in the neighborhood of the supporting section 17*b* of the lead screw 17. With respect to the lead screw, the revolution quantity is regulated due to the fact that the control section 27 regulates the driving source based on the electric signal of the sensor 26.

As described above, in the present embodiment, when the driven gear revolves and thus with the driving gear 30 being revolved by the driven gear, the lead screw 17 having the same axis as the driven gear 17*a* revolves in terms of the female screw section 35, thus moving in the direction from right 117R to left 117L along the axis line 117 of FIG. 3. For this reason, the tension of the endless belt type photographic body 21 is regulated to an appropriate value so as to be maintained because the driven rollers 24 supported by the supporting section 17*b* moves either in the direction opposite to the tension of the endless belt type photographic body 21 or in the direction of regularity as well as i.e., analogous to, the first embodiment.

The Japanese Patent Application Laid-Open No. HEI 3-214452 discloses a mechanism and method for adjusting the tension of tape. The mechanism described in HEI 3-214452 is not a recording device but an audio control, however, since the characteristic is that tape is open ended, there is provided a supply motor, a winding motor, rotary head driving motor and so forth. There is a function for detecting tension that is functioning to the tape through a condition observer from a revolution signal of the rotary head motor to for control. For instance, if there is intended to apply such a mechanism to the tension control of the endless belt type photographic body of the recording device of the present invention, then it becomes necessary to prepare more than two driving rollers. It is necessary to control a plurality of driving motors while providing a condition observer, thus becoming a remarkably complicated device as compared to the instant invention.

The Japanese Patent Application Laid-Open No. HEI 4-168644 discloses a video device which has a function of reducing the tension variation of the video tape that accompanies the variation of load on an operation of the device and with eccentricity of the roller and so forth. The video device described above does not provide any method to adjust the tension variation that accompanies the change of temperature and humidity in the employment surroundings and with the change over time.

On the other hand, the recording device according to the first and the second embodiments of the present invention causes the driven rollers 24 to move based on the detection of the belt tension. According to the simple configuration, which enables a variation of a belt tension to be regulated timely even if there is the change of length of the endless belt type photographic body caused by temperature and humidity of the employment surroundings or a change with time. On account of this matter, it is capable of preventing a deterioration of output quality of an image formation while suppressing oscillation of the endless belt type photographic body 21 or a change of belt feeding speed. With regard to the endless belt type photographic body 21, it is necessary to exchange the belt periodically because of fatigue caused by heat and light, charging, discharging and so forth. However, in the recording device according to the first and the second embodiment, it is not necessary to regulate the belt tension manually in every exchange because it is capable of being regulated automatically so as to always have an appropriate belt tension. Furthermore, it is capable of being regulated automatically so as to always have an appropriate belt tension, even though a change of load occurs which the endless belt type photographic body undergoes from respective units on the operation of the device, or a change of tension of the endless belt type photographic body that accompanies the eccentricity of the roller and so forth.

As described above, the variation of the belt length that is caused by a variation of temperature and humidity or the variation with time of employment surroundings can be handled. Variation of belt tension entailed by a load variation on the operation of the device or eccentricity of the driving roller, or the driven rollers can be handled. It is capable of being always maintained with an appropriate tension state, while absorbing looseness of the endless belt type photographic body.

While preferred embodiments of the invention have been described using specific terms, such description is for illustrative purpose only, and it is to be understood that changes and variations may be made without departing from the spirit or scope of the following claims.

What is claimed is:

1. A recording device comprising:

a driving roller, at least one driven roller, an endless belt type photographic body wound around said driving roller such that said driving roller drives said at least one driven roller, a means for detecting a tension of said endless belt type photographic body, said belt tension detection means including a deformation sensor providing an electrical signal in response to an applied deformation; and a means for movement of at least one of said driving roller and said at least one driven roller based on said electrical signal of said deformation sensor.

2. A recording device as claimed in claim 1, wherein said movement means comprises an eccentric cam whose relative position toward said driving roller is fixed, and a rod which causes one of said at least one driven roller to be reciprocated either in an approaching direction or in a departing direction with respect to said driving roller in accordance with a revolution of said eccentric cam.

3. A recording device as claimed in claim 2, wherein said sensor detects deformation under pressure of said rod, and a revolution angle of said eccentric cam being adjusted based on said electric signal from said sensor.

4. A recording device as claimed in claim 1, wherein said movement means comprises a female screw section whose relative position toward said driving roller is fixed, and a lead screw, wherein said lead screw is screwed in or out of said female screw section causing one of said at least one driven roller to be reciprocated either in an approaching direction or in a departing direction with respect to said driving roller, so as to revolve said female screw section.

5. A recording device as claimed in claim 4, wherein a sensor detects deformation under pressure of said lead screw, and wherein a revolution quantity of said lead screw is adjusted based on said electric signal from said sensor.

6. A recording device as claimed in claim 1, wherein said deformation sensor comprises at least one of a strain gage, a Hall element, a transparent optical sensor, and a reflective optical sensor.

7. A recording device comprising:

a driving roller, at least one driven roller, an endless belt type photographic body wound around said driving roller such that said driving roller drives said at least one driven roller, a means for detecting a tension of said endless belt type photographic body, means for movement of at least one of said driving roller and said at least one driven roller based on a detection signal of said belt tension detection means, wherein said movement means comprises an eccentric cam whose relative position toward said driving roller is fixed, and a rod which causes one of said at least one driven roller to be reciprocated either in an approaching direction or in a departing direction with respect to said driving roller in accordance with a revolution of said eccentric cam, and wherein said belt tension detection means comprises a sensor which detects deformation under pressure of said rod, wherein said deformation is converted into an electric signal by said sensor, and wherein a revolution angle of said eccentric cam is adjusted based on said electric signal from said sensor.

8. A recording device as claimed in claim 7, wherein said sensor comprises at least one of a strain gage, a Hall element, a transparent optical sensor, and a reflective optical sensor.

9. A recording device comprising:

a driving roller, at least one driven roller, an endless belt type photographic body wound around said driving roller such that said driving roller drives said at least one driven roller, a means for detecting a tension of said endless belt type photographic body, means for movement of at least one of said driving roller and said at least one driven roller based on a detection signal of said belt tension detection means, wherein said movement means comprises a female screw section whose relative position toward said driving roller is fixed, and a lead screw, wherein said lead screw is screwed in or out of said female screw section causing one of said at least one driven roller to be reciprocated either in an approaching direction or in a departing direction with respect to said driving roller, so as to revolve said female screw section, and wherein said belt tension detection means comprises a sensor for detecting deformation under pressure of said lead screw, said deformation converted into an electric signal by said sensor, and a revolution quantity of said lead screw being adjusted based on said electric signal from said sensor.

10. A recording device as claimed in claim 9, wherein said sensor comprises at least one of a strain gage, a Hall element, a transparent optical sensor, and a reflective optical sensor.

11. A method for controlling tension in an endless belt type photographic body that is wound around a driving roller and at least one driven roller, comprising the steps of:

detecting a tension of said endless belt type photographic body by utilizing a deformation sensor providing an electrical signal in response to an applied deformation; and moving at least one of said driving roller and said at least one driven roller based upon said electrical signal of said deformation sensor.

12. A method for controlling tension as recited in claim 11, further comprising the step of:

driving said driving roller such that said driving roller drives said at least one driven roller.

13. A method for controlling tension as recited in claim 11, wherein said deformation sensor comprises at least one of a strain gage, a Hall element, a transparent optical sensor, and a reflective optical sensor.

14. An apparatus for controlling tension in an endless belt type photographic body that is wound around a driving roller and at least one driven roller, comprising:

a deformation sensor for detecting a tension of said endless belt type photographic body, said sensor providing an electrical signal in response to an applied deformation; and wherein said deformation sensor triggering a movement of at least one of said driving roller and said at least one driven roller based upon said electrical signal of said deformation sensor.

15. An apparatus for controlling tension as recited in claim 14, wherein:

said driving roller drives said at least one driven roller, and wherein said deformation sensor comprises at least one of a strain gage, a Hall element, a transparent optical sensor, and a reflective optical sensor.

* * * * *